United States Patent [19]

Hatano et al.

[11] Patent Number: 4,623,311

[45] Date of Patent: Nov. 18, 1986

[54] CALCINING APPARATUS FOR POWDERY MATERIALS

[75] Inventors: Hirofumi Hatano; Masayasu Yamazaki, both of Kitakyushu; Atsushi Sasaki; Keigo Mikami, both of Hiroshima, all of Japan

[73] Assignee: Mitsubishi Jukogyo Kabushiki Kaisha, Tokyo, Japan

[21] Appl. No.: 757,926

[22] Filed: Jul. 22, 1985

Related U.S. Application Data

[63] Continuation of Ser. No. 446,312, Dec. 2, 1982, abandoned.

[51] Int. Cl.[4] ..... F27B 7/02

[52] U.S. Cl. ..... 432/106; 432/14; 432/58

[58] Field of Search ..... 432/14, 58, 106

[56] References Cited

U.S. PATENT DOCUMENTS

| | | | |
|---|---|---|---|
| 3,881,861 | 5/1975 | Ritzman | 432/106 |
| 3,914,098 | 10/1975 | Kano et al. | 432/106 |
| 3,986,818 | 10/1976 | Deussner et al. | 432/14 |
| 4,022,568 | 5/1977 | Meedom | 432/106 |
| 4,094,626 | 6/1978 | Boyhont et al. | 432/106 |
| 4,108,593 | 8/1978 | Christiansen | 432/14 |
| 4,218,210 | 8/1980 | Herchenbach | 432/58 |
| 4,276,020 | 6/1981 | Shibuya | 432/14 |

*Primary Examiner*—Henry C. Yuen

*Attorney, Agent, or Firm*—Wyatt, Gerber, Shoup, Scobey and Badie

[57] ABSTRACT

There is here disclosed a calcining apparatus for a powdery material comprising a first preheating series composed of a calcining kiln and preheaters at a plurality of stages for heating the powdery material with an exhaust gas from the calcining kiln, a second preheating series composed of a calcining chamber disposed on an exhaust gas pipe extending from a rotary kiln and other preheaters at a plurality of stages for heating the powdery material with an exhaust gas from a rotary kiln, a gas carrying pipe for connecting the first and second preheating series in the middle thereof, and a flow path through which the powdery material fed to first and second preheating series passes is provided with a powdery material carrying pipe for connecting both series in front of second preheaters from the bottom in both series, and is further provided with a combining duct for combining powdery materials from both the series in the rear of the second preheaters from the bottom in both series, the flow path for the powdery material being adapted so that the powdery material fed to each series may be led into the rotary kiln via the combining duct and then via the undermost traveling portions of both series.

1 Claim, 3 Drawing Figures

CALCINING APPARATUS FOR POWDERY MATERIALS

Figure 1:
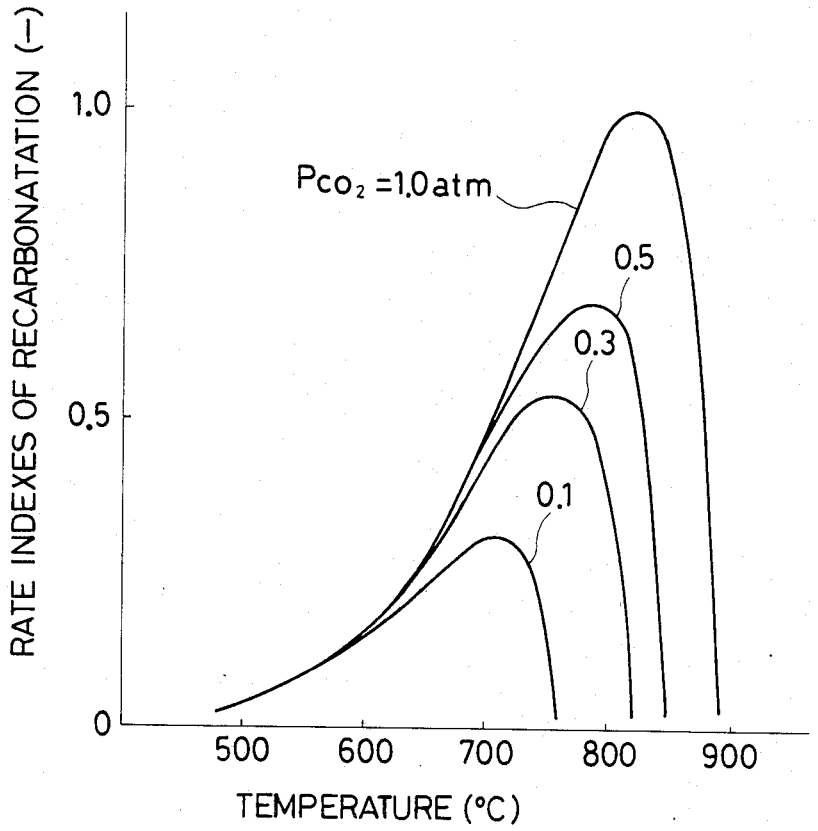

This application is a continuation of Ser. No. 446,312, filed Dec. 2, 1982, now abandoned.

This invention relates to a calcining apparatus composed of a multi-stage suspension preheater and a calcining kiln for calcining a powdery substance to be fed to a rotary kiln, more particularly to a calcining apparatus whereby the degree of calcination of the powdery material, which will generate carbon dioxide gas and the like by means of the calcination, can be increased to the maximum level of about 100%, recarbonation of the powdery material which flows back with a gas can be prevented, and thermal efficiency of the whole calcining apparatus can thus be improved.

Examples of powdery materials which can be calcined by the calcining apparatus according to this invention include cement materials, limestone, dolomite and magnesite, but the cement materials are most common.

The prevalent multi-stage suspension preheaters now generally employed are usually constructed by stacking a plurality of combinations each of which comprises a solid-gas separator and a riser. The presently employed calcining kilns have a fuel feeding device and a fluidized bed.

typical calcining apparatus comprising a combination of a multi-stage suspension preheater and a calcining kiln, already known include incorporated calcining kiln systems, separate calcining kiln gas combining systems and separate calcining kiln gas parallel flow systems.

A calcining apparatus of the incorporated calcining kiln system has a calcining kiln, equipped with a fuel feeding device, which is connected in series between a rotary kiln and a multi-stage suspension preheater, in which all of the exhaust gas from the rotary kiln is caused to pass through the calcining kiln. Air necessary for combustion is generally introduced directly to the calcining kiln and is mixed with the exhaust gas therein.

A separate calcining kiln gas combining system has a calcining kiln, equipped with a fuel feeding device, which is disposed in parallel with a rotary kiln, whereby the exhaust gas from the calcining kiln and the exhaust gas from the rotary kiln are combined and then fed to the multi-stage suspension preheater. A separate calcining kiln gas parallel flow system has a calcining kiln and a rotary kiln which are disposed in parallel with each other, and in this system, exhaust gases from these kilns are not combined.

In order to assure the mechanisms of heat exchange between the solid and gas and the calcination of the powdery material in the calcining apparatus, it is necessary that the powdery material and the gas are well mixed under conditions which will assure that there is sufficient time and space to allow the calcination to proceed satisfactorily. Further, since lower partial pressure of carbon dioxide gas in the exhaust gas, and higher temperatures of the exhaust gas increase the rate of calcination, it is necessary to lower the partial pressure and to elevate the temperature of the gas.

A calcining kiln which is equipped with a fuel feeding device and an air intake for the purpose of burning a fuel is required to burn the fuel on the upstream side of the calcining kiln as much as possible so that the generated heat is utilized effectively for the calcination of the powdery material. Accordingly, the temperature of the gas on the upstream side in the calcining kiln can be raised to accelerate the calcination, and the temperature of the gas at the exit of the same can be lowered. In order to assure efficient burning of the fuel in the calcining kiln, it is necessary that the fuel and air are well mixed and that the partial pressure of oxygen therein is as high as possible. Further, it should be noted that the higher the ratio (a combustion-improving ratio) of an amount of fuel fed to the calcining kiln to the total amount of fuel fed to the whole calcining apparatus, that is to say, the higher the calcination degree of the powdery material, the higher will be the temperature of the exhaust gas at the exit of the calcining kiln.

Another factor which must be considered is the problem of recarbonation of the powdery material which is not separated by the solid-gas separator connected to the calcining kiln, but instead flows back to the preheater with the gas. Recarbonation increases with increasing degree of calcination of the powdery material, with collection efficiency of the solid-gas separator connected to the calcining kiln, and with increasing partial pressure of carbon dioxide in the gas. Maximum recarbonation takes place at a temperature of 750° to 800° C. Since the recarbonation is an exothermic reaction, the temperature of the gas on the upstream side in the preheater will be elevated, and the temperature of the exhaust gas on the downstream side will also be elevated thereby lowering the thermal efficiency of the system. Therefore, the recarbonation should be avoided as much as possible.

Now, reference will be made to experimental facts discovered by the coinventors herein regarding recarbonation of calcined powdery limestone material which form the basis of this invention.

It has been experimentally confirmed, for example, that the rate index (r) of recarbonation of a cement material which contains limestone in a proportion of about 80% is represented by formula (1) below:

$$r = K \frac{\frac{P_{CO_2}}{P^*_{CO_2}} - 1}{b\,P_{CO_2} + d} \tag{1}$$

wherein r is Rate index (−) of recarbonation of the cement material

K is Constant (=3.57);

$P_{CO_2}$ is Partial pressure of carbon dioxide (atm);

$P_{CO_2}$ is Equilibrium partial pressure of carbon dioxide (atm);

$$b = 4.289 \times 10^{-12} \exp \frac{61450}{1.987T};$$

$$d = 5.757 \times 10^{-9} \exp \frac{39506}{1.785T};$$

and

T is Reaction temperature (°K.).

FIG. 1 attached hereto indicates that the higher the partial pressure $P_{CO_2}$ of carbon dioxide in each gas to be brought into contact with the cement material, the greater the rate indexes r of the recarbonation becomes Moreover, in the temperature ranges on the right side of each curve in FIG. 1, the rate of recarbonation is less than 0. Therefore it is definite that the de-carboxylation reaction occurs in such a temperature range.

In the calcining apparatus of the separate calcining kiln system, the higher this combustion-improving ratio, the more smoothly the calcination of the powdery material proceeds in the section of the apparatus from the calcining kiln to the undermost solid-gas separator. Since the calcination of the powdery material up to the undermost solid-gas separator on the side of the rotary kiln is low, the exhaust gas from the calcining kiln includes $CO_2$ generated from the fuel and additionally $CO_2$ separated from the material, and the concentration of $CO_2$ in the gas is high (about 40%), but the exhaust gas from the rotary kiln includes $CO_2$ from the fuel for the most part. As a result is low (about 20%). On the other hand, the temperature of the exhaust gas from the calcining kiln is near to 900° C., and that from the rotary kiln is only slightly above 800° C. Therefore the troublesome recarbonation tends to occur on the side of the calcining kiln.

In view of the mechanisms of the heat exchange and the calcination as well as the recarbonation reaction mentioned above, conventional calcining apparatus will be discussed as follows:

In the incorporated calcining kiln system, air and the exhaust gas from the rotary kiln are mixed with each other. Therefore, the partial pressure of oxygen is lower, compared with the case of the separate calcining system, and the amount of the gas, though depending on a combustion-improving ratio, is approximately twice as much as that of the gas treated in the separate calcining kiln, since the gas generated by calcination is added to the above mixed gas. The combustion rate of the fuel will low down because of the low partial pressure of oxygen for the combustion, and the temperature increase of the gas is restrained due to the large volume of gas. Additionally, the space which may be effectively used for calcination will be reduced As a result, the heat exchange in a calcining section is insufficient, so that the temperature of th exhaust gas increases compared with the case of the separate calcining kiln system. In order to avoid this disadvantage, it is necessary to install a calcining kiln having at least twice the volume of the separate calcining kiln system, and a large space must be available between the rotary kiln and the preheater. Accordingly, it is necessary to construct a preheater and the associated frame work for supporting the same which is very high. The functional difference between these systems increases when the fuel used is changed from petroleum to coal. To limit these differences the grain size of the coal must be reduced. This requires the expenditure of a large amount of electric power to grind the coal.

In the case of the incorporated calcining kiln system, the partial pressure of carbon dioxide at the exit of the calcining kiln is not changed by the combustion-improving ratio, but as compared with the separate calcining kiln gas combining system, the exhaust gas temperature is higher for the above reason. Consequently, the recarbonation of the powdery material which flows back with the gas is greater, and the temperature in the preheater is further elevated. As a result the incorporated calcining kiln system is poor in thermal efficiency. The greater the above-mentioned combustion-improving ratio, the greater the difference in the thermal efficiency between both of the systems becomes.

In the gas combining system including the separate calcining kiln, the amount of the gas in the calcining area between the rotary kiln and the preheater is the same as in the incorporated calcining kiln system. Therefore the gas combining system is poorer in respect of residence time compared with the gas parallel flow system including the separate calcining kiln through which the exhaust gas from the rotary kiln passes.

In the case of the separate calcining kiln gas parallel flow system, the mechanisms of calcination and recarbonation vary slightly. One variation is to permit the powdery material discharged from the second solid-gas separator from the bottom of the multi-stage suspension preheater to first pass through the series on the rotary kiln side. Another variation is to permit the aforementioned material to first pass though the series on the calcining kiln side. When the powdery material is first allowed to pass through the series on the rotary kiln side, the function of this series is chiefly to preheat the powdery material, and the calcination is low, therefore the gas temperature and the partial pressure of carbon dioxide gas are both at a low level. As a result there is little recarbonation in the preheater. On the other hand, the function of the series on the calcining kiln side is chiefly the calcination. As a result a large amount of carbon dioxide gas will generate and its partial pressure will thus be higher and the temperature in the series will correspondingly be higher. Accordingly, in the preheater on this series side, there are adverse effects such as acceleration of the recarbonation and temperature rise of the preheater.

Inversely, in the case that the powdery material is first allowed to pass through the calcining series, the function of this series is chiefly to calcine the powdery material, through preheating is also effected to some extent. As a result the partial pressure of carbon dioxide gas in the exhaust gas from the calcining kiln will be higher. However, since calcination is completed out with the exhaust gas from the rotary kiln, the calcination of the powdery material in the series on the calcining kiln side is somewhat lowered. Therefore, conditions of the calcination are such that the temperature of the exhaust gas will drop, so that the calcination of the powdery material which flows back is low. Recarbonation in the preheater on this series side is inhibited to some extent. On the other hand, the function of the exhaust gas from the rotary kiln is mainly to calcine the powdery material, but the level of this calcination is low, the partial pressure of carbon dioxide gas will not be heightened, and the gas temperature is relatively low. Therefore recarbonation in this series is.

It is thus apparent that when gas combining systems are compared with the gas parallel flow system the latter is somewhat better in thermal efficiency than the former.

It will also be seen that when a calcining apparatus comprising the combination of the conventional multi-stage suspension preheater and the calcining kiln is studied regarding points of heat exchange function, calcination function and recarbonation reaction, the separate calcining kiln gas parallel flow system is superior.

However, in this system there is the problem of unbalance between the gas parallel flow paths, as mentioned above. That is to say, the exhaust gas from the calcining kiln carriers more sensible heat than the exhaust gas from the rotary kiln, and it is difficult to maintain the sensible heat of the exhaust gas at a minimum level even by adjusting the flow rate of the powdery material in each series. Accordingly it is clear that the system is low in thermal efficiency. Further, when an attempt is made to raise the calcination degree of the powdery material, this unbalance will be increased. Furthermore, in the separate calcining kiln gas parallel flow system, the unbalances of a gas temperature and a carbon dioxide concentration tend to bring about the recarbonation reaction of the powdery material, and there is no step to prevent recarbonation in the system. In addition, when the combustion-improving ratio is increased, or when coal which is low in combustion rate is employed in the calcining kiln, the sensible heat carried by the exhaust gas from the calcining kiln will increase and this will lead to poor thermal efficiency, calcination degree and recarbonation.

An object of the invention is to provide a calcining apparatus wherein a conventional calcining apparatus of the above-mentioned separate calcining kiln gas parallel flow system is improved and whereby the calcination degree of a powdery material can be increased to the maximum level of approximately 100%, the recarbonation of the powdery material which flows back with the gas can be prevented, and thermal efficiency can be further improved.

This invention is directed to a calcining apparatus for powdery material comprising a first preheating series (hereinafter referred to as Series I) composed of a separate calcining kiln and preheaters at a plurality of stages for the heating the powdery material with an exhaust gas from the calcining kiln, a second preheating series (hereinafter referred to as Series II) composed of a calcining chamber disposed on an exhaust gas pipe extending from a rotary kiln and other preheaters at a plurality of stages for heating the powdery material with an exhaust gas from a rotary kiln, a gas carrying pipe for connecting the first and second preheating series in the middle thereof. A flow path through which the powdery material fed to first and second preheating series passes is provided with a powdery material carrying pipe for connecting both the series ahead of second preheaters, i.e. at exits of third solid-gas separators, from the bottoms in both the series, and is further provided with a combining duct for combining powdery materials from both the series in the rear of the second preheaters, i.e. at exits of second solid-gas separators, from the bottoms in both the series, and the flow path for the powdery material being adapted so that the powdery material fed to each series may be led into the rotary kiln via the combining duct and then via the undermost traveling portions of both series.

According to this invention, the powdery material which flows back to the preheater with the gas is forced to lead into a section having a low temperature on the side of the calcining kiln, though in the preheater there exists a high partial pressure of $CO_2$, i.e. a condition of bringing about the recarbonation in a prompt manner, whereby the rate of the re-carbonatation is lowered.

In other words, in the case of a conventional process, gases exhausted from the respective solid-gas separators on the calcining kiln side and the rotary kiln side are mixed with the materials at the exits of the solid-gas separators which are sited at one upper stages to effect heat exchange, so that temperatures of the gases in the respective separators will become about 800° C. in one, and a little lower than 700° C. in the other. Therefore, between one solid-gas separator and the solid-gas separator just above it, the recarbonation rate of the powdery material flowing back with the gas will be noticeably high on the calcining kiln side, but will be low on the rotary kiln side. Specifically, the exothermic heat resulting from vigorous recarbonation of the calcining kiln side will further heighten the temperature of the exhaust gas in the second solid-gas separator from the bottom of the series on the above side, and at last the temperature of the exhaust gas in the uppermost solid-gas separator will be raised, which fact will render the recovery of heat low.

Still further, according to this invention, the materials collected by the third solid-gas separators from the bottoms of both the series are fed to an exit duct extending from a solid-gas separator on the calcining duct side and the resulting combined material is further mixed with the material about twice as much as and the gas as much as the above collected material, whereby the temperature of the gas in the second solid-gas separator from the bottom of the preheater on the calcining duct side can be lowered to about 700° C., though the partial pressure of $CO_2$ remains high. As a result, the recarbonation rate will be reduced, and the temperature rise caused by the exothermic heat will be thus inhibited to drop the temperature of the exhaust gas in the uppermost solid-gas separator. On the rotary kiln side, the temperature of the exhaust gas from the second solid-gas separator from the bottom inversely rises to about 750° C., but the partial pressure of $CO_2$ is low and the peak of the recarbonation rate lies in the vicinity of this temperature. Therefore, the recarbonation rate and the temperature rise caused by the exothermic heat merely increase by a minimal degree, so that the temperature of the exhaust gas from the uppermost solid-gas separator on the same side wall scarcely rise.

Figure 2:
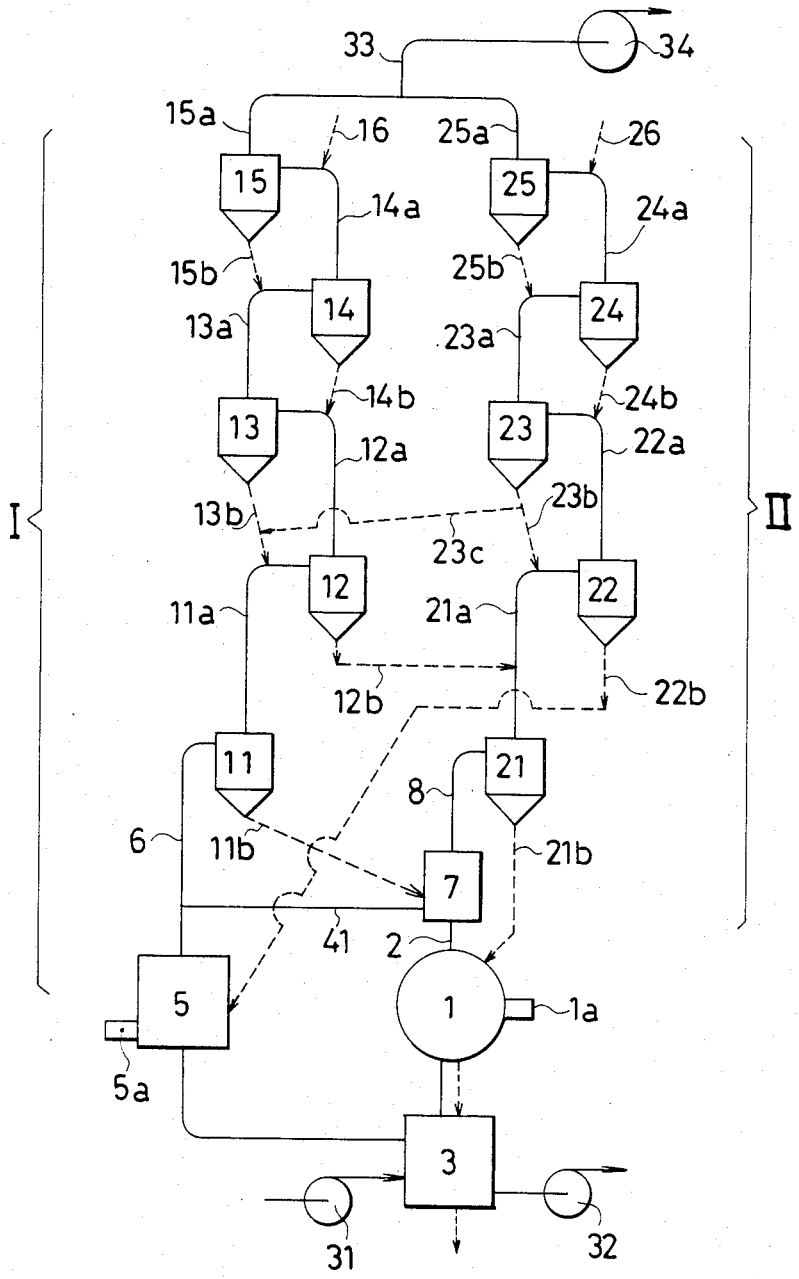
Figure 3:
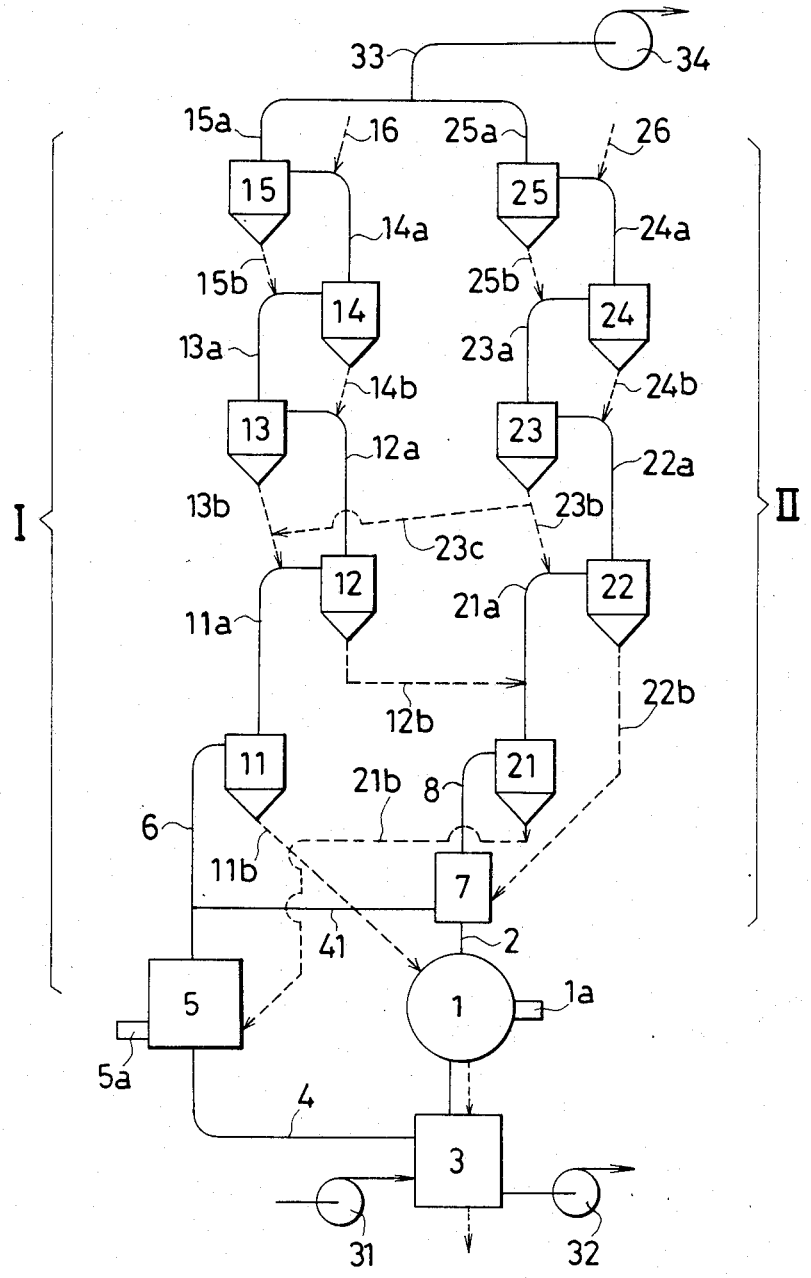

The above-mentioned and other objects, features and advantages of this invention will become more apparent from the following description given with reference to the accompanying drawings, in which:

FIG. 1 is a diagram showing relations of rate indexes of recarbonation with respect to temperatures of each gas having a certain partial pressure; and FIGS. 2 and 3 are flow sheets showing different embodiments of the invention.

Referring now to FIG. 2 of the accompanying drawings, reference numeral 1 is a rotary kiln, numeral 1*a* is a device for burning a fuel attached to the rotary kiln, numeral 2 is an exhaust gas pipe extending from the rotary kiln, 3 is a cooling device for cooling a calcined material, 4 is a bleeding pipe extending from the cooling device, 5 is a calcining kiln, 6 is an exhaust gas pipe extending from the calcining kiln, 7 is a calcining chamber and 8 is a riser extending from the calcining chamber. In the drawing, the solid lines and the dotted lines represent passages for air and gases, and flow paths for a powdery material, respectively.

This embodiment includes preheating systems of Series I and Series II and a gas carrying pipe for connecting these series.

Series I is composed of the calcining kiln 5, a multi-stage suspension preheater in which solid-gas separators 11, 12, 13, 14 and 15 connected to the exhaust gas pipe 6 extending from the calcining kiln 5 and risers 11*a*, 12*a*, 13*a*, 14*a* and 15*a* are stacked in a multi-stage form.

The calcining kiln 5 on the Series I side which is provided with a fuel feeding device 5*a*, serves to burn the fuel with air which is bled from cooling device 3, and is disposed separate from but parallel to the rotary kiln 1. In this case, a flow calcining kiln utilizing crushed coal as a fuel may be utilized as the calcining kiln. Even with this condition, efficient calcination can be obtained.

Series II is composed of the calcining chamber 7 disposed on the pipe for carrying the exhaust gas extending from the rotary kiln and the multi-stage suspension preheater comprising the solid-gas separators 21, 22, 23, 24 and 25, which communicate with riser 8 extending from the calcining chamber 7, and risers 21*a*, 22*a*, 23*a*, 24*a* and 25*a*. These numbers are combined and stacked in a plurality of stages.

The calcining chamber 7 is an upright cylinder which is disposed on the exhaust gas carrying pipe 2 extending from the rotary kiln and has no device for feeding fuel. In this calcining chamber 7, there is sufficient heat exchange between the powdery material and the exhaust gas from the rotary kiln to heat the powdery material or to finish the calcination. The installation of the calcining chamber 7 permits enough heat exchange between the solid and the gas to increase the calcination degree of the powdery material to approximately 100%. In the calcining chamber 7, the exhaust gas from the calcining kiln 5 is partially introduced as described below, but the temprature of the gas therein will be lowered by allowing heat exchange between the solid and the gas to be sufficiently carried out. The exhaust gas from kiln 5 will be diluted with the exhaust gas discharged from the rotary kiln 1 including carbon dioxide gas at a low concentration. Therefore, there will be little recarbonation of the powdery material flowing back in Series II.

A gas carrying pipe 41 is disposed between the gas flow paths in Series I and II, i.e. between the exhaust gas carrying pipe 6 extending from the calcining kiln and the calcining chamber 7. Pipe 41 may also be connected to the top of calcining kiln 5. In addition to or in place of the gas carrying pipe 41, another gas carrying pipe may be disposed between the riser 11*a* extending from the lowest solid-gas separator 11 in Series I and the riser 21*a* extending from the lowest solid-gas separator 21 in Series II so as to connect the series to each other.

Pipes 16, 26 for feeding the powdery material are fixed to gas inlet pipes 14*a*, 24*a* extending from the highest- solid-gas separators 15, 25 in Series I and II, respectively. Passages 15*b*, 25*b* for feeding the powdery material extending from the solid-gas separators 15, 25 are connected to gas carrying pipes 13*a*, 23*a* extending from the solid-gas separators 14, 24 which are positioned below the above passages, and passages for feeding the powdery material extending from the solid-gas separators 14, 24 are connected to gas carrying pipes 12*a* and 22*a* extending from the solid-gas separators 13, 23 which are positioned therebelow. In this way, the passages for the powdery material are disposed downward along Series I and II to third solid-gas separators 13, 23 in Series I and II.

The passages 13*b*, 23*b* for feeding the powdery material extending from the third solid-gas separators 13, 23 are connected to gas carrying pipes 11*a*, 21*a* extending to solid-gas separators 12, 22. Passages 13*b* and 23*b* are also connected to each other via a pipe 23*c* for carrying the powdery material pipe 23*c* may alternately be directly connected to the gas carrying pipe 11*a* extending to the solid-gas separator 12. A passage 12*b* extending from solid-gas separator 12 in Series I is connected to gas carrying pipe 21*a* extending to solid-gas separator 22 in Series II.

A passage 22*b* extending from solid-gas separator 22 is a combining duct in which the powdery materials from Series I and II are combined with each other, and this combining duct 22*b* is connected to the calcining kiln 5. A passage 11*b* for feeding powdery material extending from the lowest solid-gas separator 11 in Series I, which communicates with the calcining kiln 5, is connected to the calcining chamber 7. And, a passage 21*b* for feeding the powdery material extending from the lowest solid-gas separator 21 in Series II, which communicates with the calcining chamber 7, is connected to the rotary kiln 1.

There follows a discussion concerning the flow of gases and the powdery material in the apparatus according to this invention.

Air blown into the cooling device 3 by a pressure fan 31 which is attached to the device 3 is led into the rotary kiln 1 and the calcining kiln 5 to be utilized for combustion, a part of the air being discharged to the atmosphere by a fan 32.

The gas generated by the combustion in the calcining kiln 5 calcines the powdery material, and is led, together with a gas resulted from its calcination and the powdery material, into the solid-gas separator 11 and the calcining chamber 7 separately through the exhaust gas carrying pipe 6 and the gas carrying pipe 41. The gas discharged from the solid-gas separator 11 rises along Series I via the risers 11*a*, is then discharged from the highest solid-gas separator 15, and is exhausted through a duct 33 and a drawing electric fan 34.

The gas generated by the combustion of the fuel in the rotary kiln 1 is led into the calcining chamber 7 via the gas passage 2, rises along Series II together with the gas coming from Series I via the gas carrying pipe 41, and reaches the drawing electric fan 34.

The gas carrying pipe 41 guides a portion of the exhaust gas from the calcining kiln 5 to the calcining chamber 7 in order to increase the efficiency of the heat exchange in the calcining chamber 7, whereby the calcination of the powdery material in the calcining chamber 7 can be completed, the flow rate of the exhaust gas from the calcining kiln including carbon dioxide at a high concentration in Series I can be reduced, and the gas in Series I can be brought into contact with a large amounts of the powdery material to drop the temperature of the gas promptly, which helps to prevent recarbonation of the powdery material flowing back in Series I. In Series II, however, the exhaust gas from the calcining kiln is diluted with the exhaust gas from the rotary kiln, in which the concentration of carbon dioxide is low, to drop the temperature of the gas, therefore no problem of recarbonation occurs.

Further, the installation of the gas carrying pipe permits equalization of the flow rate of the gases in Series I and II, uniformization of the temperature of the gas and regulation of the concentration of carbon dioxide gas, and thanks to the gas carrying pipe, the flow rate of the powdery material passing through solid-gas separators 12, 22 in Series I and II can be adjusted in order to minimize recarbonation of the powdery material.

The flow rate of the gas passing through the gas carrying pipe can be regulated by setting the combustion-improving ratio to an optimum condition for maximizing the heat efficiency all over the system, taking the calcination degree of the powdery material and the recarbonation of the powdery material flowing back into consideration. A device for adjusting the flow rate of the gas may optionally be provided, if desired.

The powdery material is fed at the top of each of Series I and II through the feeding pipes 16, 26 and the separated materials descend in parallel along the preheaters of the respective series to the solid-gas separators 13, 23. The powdery material discharged from the separator 13 and all or a portion of the powdery material discharged from the separator 23 are forwarded to the second solid-gas separator 12, and the mixed powdery material discharged from this separator 12 is led into the rotary kiln 1 via the second solid-gas separator 22 of Series II, the calcining kiln 5, the lowest solid-gas separator 11 of Series I, the calcining chamber 7 and the lowest solid-gas separator 21 of Series II.

Because construction of the flow path for the powdery material, the gas temperature in the inlet pipe 11*a* solid-gas separator 12 is lowered due to the large amount of powdery material, whereby the recarbonation of the powdery material which flows back can be restrained. It is most preferable that all of the powdery material be fed to the riser 11*a*, but this is not essential.

Further, the powdery material can carry out a solid-gas heat exchange while traveling through the solid-gas separators 12, 22 of Series I and II, a calcining kiln 5, the undermost solid-gas separator 11 of Series I, the calcining chamber 7 and the undermost solid-gas separator of Series II, whereby the calcination degree of about 100% can be achieved and the thermal efficiency can also be improved.

The gas carrying pipe 41 of this embodiment cooperates with the calcining chamber 7 and the powdery material carrying pipe 23*c* not only to accomplish the improvement in the heat exchange efficiency of the calcining apparatus, the perfect calcination of the powdery material and the prevention of recarbonation, but also to equalize the gas flow and the gas sensible heat of Series I to those of Series II. Therefore, Series I and II can be built in the same shape and are interchangeable, one result being that design, manufacture and fitting of the series are easy. This leads to reduction in equipment and maintenance cost. The drawing electric fan 34 can be used to serve both series, therefore equipment and electric power costs can be saved. The above uniformization of the flow rate of the powdery material between Series I and II can be controlled and stabilized easily.

The installation of the gas carrying pipe permits the operation of either series alone, so that of there is trouble at a local position, the suspension of the whole apparatus can be avoided. Moreover at startup the only combustion device needed is the rotary kiln 1.

The construction of the calcining apparatus of this invention makes possible greatly improved calcination of powdery material, prevention of recarbonation and improved heat exchange efficiency. The operation can easily be controlled, even when the combustion-improving ratio of the calcining kiln 5 is heightened, or when a crushed coal which is low in combustion rate is employed as the fuel in the calcining kiln 5.

Referring now to FIG. 3 in which another embodiment of this invention is shown, the traveling channel of the powdery material is altered so that the powdery material separated in the solid-gas separator 22 may be fed to the rotary kiln through a combining duct 22*b* extending from the solid-gas separator 22, the calcining chamber 7, the solid-gas separator 21, the calcining kiln 5 and the solid-gas separator 11.

The embodiment shown in FIG. 3 has about the same functional effects as in the embodiment shown in FIG. 1. In the embodiment shown in FIG. 3, however, a portion of the powdery material is recycled through the calcining kiln 5, the gas carrying pipe 41, the calcining chamber 7, the riser 8 and the solid-gas separator 21. Therefore the residence time of the powdery material in the calcinating section can be extended to further calcine the powdery material to a complete degree, though the concentration of carbon dioxide gas in Series I is higher than in the embodiment shown in FIG. 1.

According to the calcining apparatus of this invention which is constructed as above described, the following effects can be obtained:

(1) The calcination degree of the powdery material which will generate carbon dioxide gas under the calcination can be increased up to nearly 100%.

(2) It is possible to restrain the recarbonation of the powdery material which flows back with the gas and to prevent loss in thermal efficiency. As a result solely of the prevention of the recarbonation according to this invention, the consumption of the fuel is reduced by as much as 3 to 6 Kcal/Kg of clinker.

(3) The residence time of the combustion gas in the calcining section is extended to permit efficient the solid-gas heat exchange, whereby the thermal efficiency can be improved noticeably.

(4) The two preheating series are balanced by the gas carrying pipe, so that the apparatus can easily be operated. Further, the multi-stage suspension preheaters in both the series can be built in the same shape and can be miniaturized to reduce constriction and maintenance cost.

(5) Moreover, the gas carrying pipe is utilized, whereby the apparatus can be operated with either preheating series alone, and heating-up can be accomplished with only the rotary kiln.

(6) When the calcining apparatus is combined with the calcining kiln as disclosed herein crushed coal or the like can be used as the fuel with good efficiency.

What is claimed is:

1. A calcining apparatus for a powdery material comprising:

a. a first preheating series composed of a calcining kiln and a first series of preheaters comprising a plurality of solid gas separators for heating the powdery material with an exhaust gas from said calcining kiln, b. a second preheating series comprising a rotary kiln having an exhaust pipe, a calcining chamber disposed on the exhaust pipe and a second series of preheaters comprising a plurality of solid gas separators for heating the powdery material with the exhaust gas from the calcining chamber, c. two gas carrying conduits, one between the calcining chamber 7 and the exhaust conduit 6 running from the calcining kiln and the first gas separator in the first series, the second between exhaust conduits 11*a* and 21*a* running from each of first gas separators to the second gas separators in each series, d. separate feed ports for feeding separate portions of the powdery materials into each of said series, said feed ports being positioned so that one portion of the powdery material is fed into the exhaust gas from the first series just before the exhaust gas enters the last preheater in the first series and the second portion of the powdery material is fed into the exhaust gas from the second series just before the exhaust gas enters the last preheater in the second series, e. a first powdery material carrying conduit connecting the two series located between second and third preheater above the calcining kiln of the first series and the second and third preheaters above the calcining chamber in the second series adapted to permit mixing of at least a portion of the powder from the second series with the powder of the first series and to thereafter pass into the second preheater above the calcining kiln, f. a flow path for conducting the powdery material from the second preheater above the calcining kiln to the rotary kiln, said flow path comprising successively (a) the second preheater above the rotary kiln, (b) the calcining kiln, (c) the calcining chamber, the first preheater above the rotary kiln, and (d) the rotary kiln.

* * * * *

UNITED STATES PATENT AND TRADEMARK OFFICE

CERTIFICATE OF CORRECTION

PATENT NO. : 4,623,311

DATED : November 18, 1986

INVENTOR(S) : HIROFUMI HATANO; MASAYASU YAMAZAKI

It is certified that error appears in the above—identified patent and that said Letters Patent is hereby corrected as shown below:

Title page:

LINE 73

After "Kaisha," and before "Tokyo" insert

—Mitsubishi Mining & Cement Co., Ltd.—

Signed and Sealed this

Nineteenth Day of April, 1988

*Attest:*

*Attesting Officer*

DONALD J. QUIGG

*Commissioner of Patents and Trademarks*